US005820186A

United States Patent [19]

Schmitz, Jr. et al.

[11] Patent Number: 5,820,186

[45] Date of Patent: Oct. 13, 1998

[54] APPARATUS FOR LIFTING PIPES AND OTHER OBJECTS

[76] Inventors: John W. Schmitz, Jr., 382 Prince Frederick St., King of Prussia, Pa. 19406; Michael J. Uhrin, 634 14th Ave., Prospect Park, Pa. 19076

[21] Appl. No.: 818,538

[22] Filed: Mar. 14, 1997

Related U.S. Application Data

[60] Provisional application No. 60/013,496 Mar. 15, 1996, and provisional application No. 60/017,428, May 8, 1996.

[51] Int. Cl.[6] ..... B66C 1/66

[52] U.S. Cl. ..... 294/93; 294/97

[58] Field of Search ..... 294/93, 95, 97, 294/67.3, 67.31, 82.1, 82.11, 82.24, 82.31, 89

[56] References Cited

U.S. PATENT DOCUMENTS

| | | | |
|---|---|---|---|
| 921,146 | 5/1909 | Naul | 294/97 |
| 1,890,734 | 12/1932 | Kuberka | 294/97 |
| 2,584,124 | 2/1952 | Gustafson | 294/93 |
| 3,307,871 | 3/1967 | Russell et al. | 294/97 |
| 3,385,627 | 5/1968 | Zumbo | 294/93 |
| 3,583,753 | 6/1971 | McCrory | 294/97 |
| 3,636,594 | 1/1972 | Faivre | 294/170 |
| 4,838,595 | 6/1989 | Spillar | 294/97 |
| 5,482,341 | 1/1996 | Schmitz | 294/93 |

FOREIGN PATENT DOCUMENTS

| | | | |
|---|---|---|---|
| 2689800 | 10/1993 | France | 294/97 |
| 2691139 | 11/1993 | France | 294/97 |
| 626014 | 9/1978 | U.S.S.R. | 294/97 |

*Primary Examiner*—Dean Kramer
*Attorney, Agent, or Firm*—Mark A. Garzia

[57] ABSTRACT

An apparatus for lifting pipe including an arm having a substantially rectangular cross-section, and a substantially cylindrical body portion pivotally mounted to the arm. The apparatus is designed to be inserted into the standard lift port of a pipe section. In addition, a handle may be attached to the arm to more easily carry and to guide the apparatus into the lifting port. The apparatus allows a single worker to quickly and efficiently lift pipe sections, while reducing the possibility of injury.

14 Claims, 9 Drawing Sheets

APPARATUS FOR LIFTING PIPES AND OTHER OBJECTS

CROSS-REFERENCE

This application claims the benefit of U.S. Provisional Application No. 60/013,496 filed Mar. 15, 1996 entitled "Apparatus For Lifting Pipes and Other Objects" by John W. Schmitz, Jr., and U.S. Provisional Application No. 60/017,428 filed May 8, 1996 entitled "Apparatus For Lifting Pipes and Similar Objects" by John W. Schmitz, Jr., and Michael J. Uhrin. The aforementioned provisional applications are incorporated herein by reference, but are not admitted as being prior art.

FIELD OF THE INVENTION

This invention relates generally to an apparatus to assist in lifting objects and more specifically to an apparatus for lifting pipes that have a lifting port.

BACKGROUND OF THE INVENTION

Pipes are used to contain and transport a variety of materials, including water, sewage, gasoline, oil, etc. Normally these pipes are buried in the ground. Therefore, the first step in the installation of an underground pipe is to choose an appropriate site and to excavate the ground to accommodate the dimensions of the pipe. The pipe is then lifted off of the bed of a truck and placed in the excavated site. Similarly, when a pipe has to be removed, the ground is excavated, and the pipe is lifted from the ground and placed on the bed of a truck.

The installation and extraction of pipes from the ground can be a lengthy and expensive process. First, the pipe is usually drained. Next, the ground around the pipe must be completely excavated. Excavation can be a tedious and dangerous process if there is a high water table, flooding or if hazardous materials have leaked into the ground.

Several apparatuses have previously been utilized to lift pipe. One apparatus consists of a loop formed at one end of a cable or chain. This is done by bolting or clamping the first end of a cable or chain onto itself as shown in FIG. 1. The second end of the chain is attached to a machine capable of lifting the pipe (e.g., a crane or backhoe).

Most sections of pipe, including reinforced precast concrete pipe (RCP), are manufactured with a lifting port or opening that is used to lift the pipe. If the pipe does not have a pre-manufactured lifting port or a similar opening, an appropriate hole may be cut into the pipe to accommodate the loop/curb pin.

The lifting port is positioned substantially in the lengthwise middle of the pipe section. A worker must enter the pipe and walk (or crawl) to the mid-point of the pipe until the worker is positioned under the lifting port. A second worker must lower the loop into the lifting port. The worker inside the pipe must then insert a curb pin through the loop. A third worker operating the crane, which is attached to the second end of the chain, retracts the chain from the pipe. The worker inside the tank may have to hold the curb pin until the slack in the chain is taken up (i.e., until the curb pin is raised high enough to engage the interior of the pipe wall), and to properly orient the curb pin with respect to the pipe section. In this manner, the tension placed on the chain by the weight of the pipe, as it is lifted, prevents the curb pin from slipping out of the loop.

The loop and curb pin combination described above may be used to lift virtually any size, length or shape of piping section. Similarly, it may be used to lift other objects that have a lifting port, for example, fittings and covers (manhole, meter, valve, access, etc.)

Another apparatus for lifting pipes consists of two "L-shaped" pipe hooks (see FIG. 2). A pipe hook is positioned at each end of the pipe section and the legs are inserted into the ends of the pipe. Consequently, two workers, one at each hook, are usually needed to steady the pipe hooks until a crane operator takes up the slack in the cable.

The aforementioned previously known apparatus require access to the interior of the pipe. Further, they are labor intensive—usually requiring three people to operate. Accordingly, previous apparatuses for lifting pipe are expensive and dangerous. Injuries to hands and fingers are not uncommon since the curb pin or pipe hook must be held in place by hand in order to attain the proper orientation. Also, the cost of providing protective gear for workers who must climb into a pipe section which previously held hazardous materials can be quite high.

SUMMARY OF THE INVENTION

An object of the present invention is to provide an improved method and apparatus for lifting pipes and similar objects from the ground.

The subject invention includes an arm and an elongate body pivotally connected to the arm. The body has a radial slot that originates from a first end of the body and extends linearly from the first end toward the second end of the body. The slot terminates at a point substantially in the lengthwise mid-region of the body, i.e., midway between the first and second ends along the axial direction of the body.

The arm is preferably an elongate bar having a first end which is pivotally connected to the body proximate the lengthwise mid point of the body (i.e., generally coinciding with the termination point of the radial slot). The arm communicates with the slot as the body pivots.

The pivot connection includes a) a pivot opening in the arm proximate the first end; b) a pair of openings in the body being diametrically opposed across the width of the slot and proximate the termination end of the slot; and c) a pin that slides through the three openings. The pin may either be permanently affixed to the body or temporarily secured.

The body is preferably cylindrical in shape. The slot is dimensioned to accept or accommodate at least a portion of the arm. The body is moveable, with respect to the arm, from a resting position, substantially parallel to the arm in which at least a portion of the arm is nestled within the slot, to a lifting position wherein the arm substantially exits the slot and the body is roatated until it is disposed substantially transverse to the arm.

When the subject apparatus is suspended by the arm, the body is biased by gravity toward a position about its pivot which is substantially parallel to the arm (i.e., its resting position). This condition is brought about since the pivot point on the body is located near to the body's center of gravity, but closer to the first end of the body (i.e., the end at which the slot commences) than is the center of gravity of the body.

DETAILED DESCRIPTION OF THE PREFERRED EMBODIMENT

Figure 2:
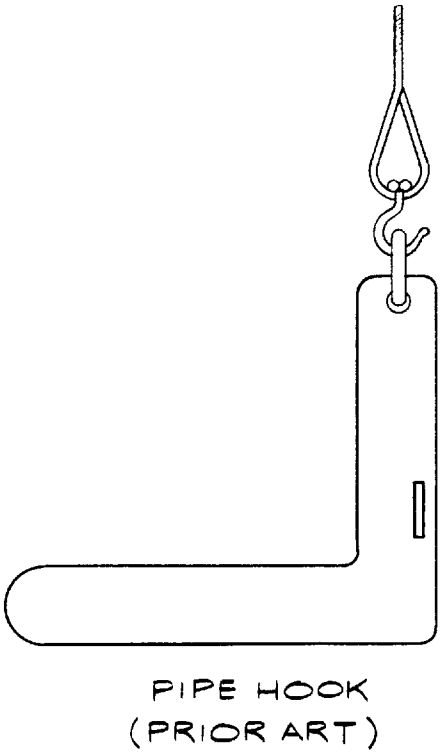
FIG. 2 is a perspective view of a prior art pipe hook device used for lifting pipes.

Referring to the drawings, an improved device for lifting and moving objects is designated generally as 10. The subject invention may be more fully appreciated by those skilled in the art when considered in connection with U.S. Pat. No. 5,482,341, issued Jan. 9, 1996, to John W. Schmitz, Jr. (application Ser. No. 08/275,028). U.S. Pat. No. 5,482,341 is hereby incorporated by reference into this application.

Figure 3A:
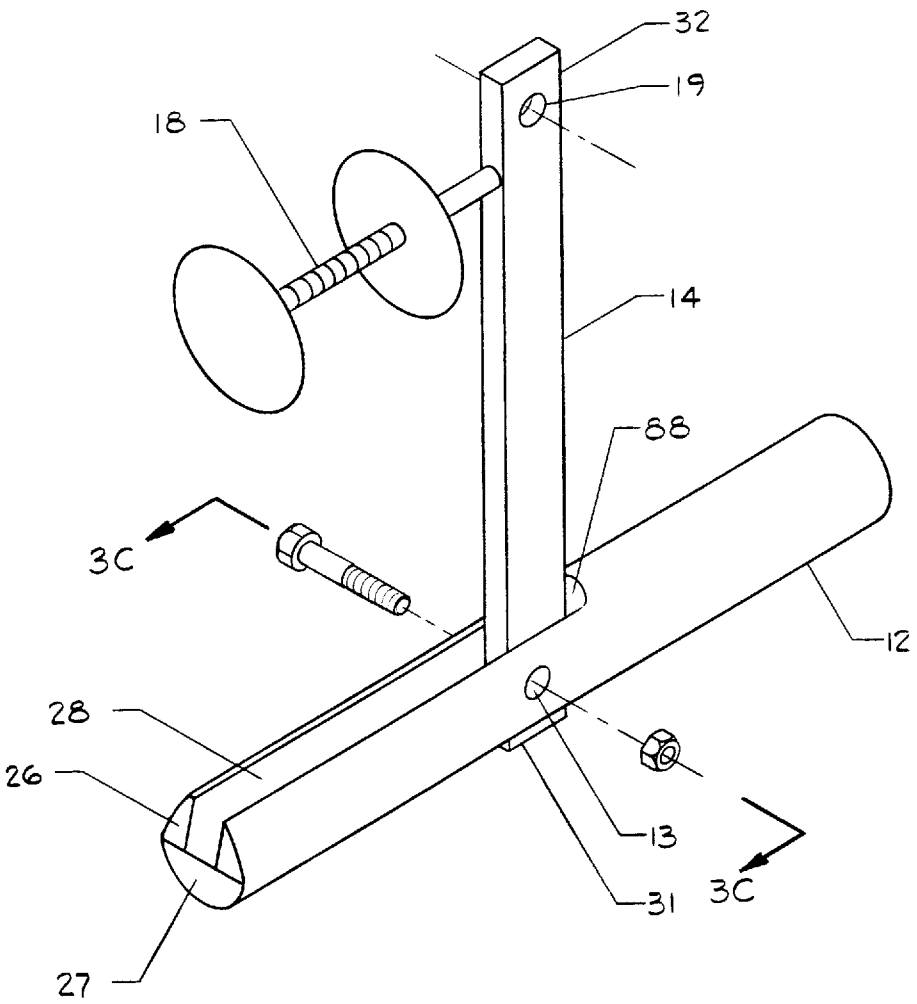
FIG. 3A is a perspective view of a lifting apparatus in accordance with the subject invention in its lifting or upside-down "T" position.
Figure 3B:
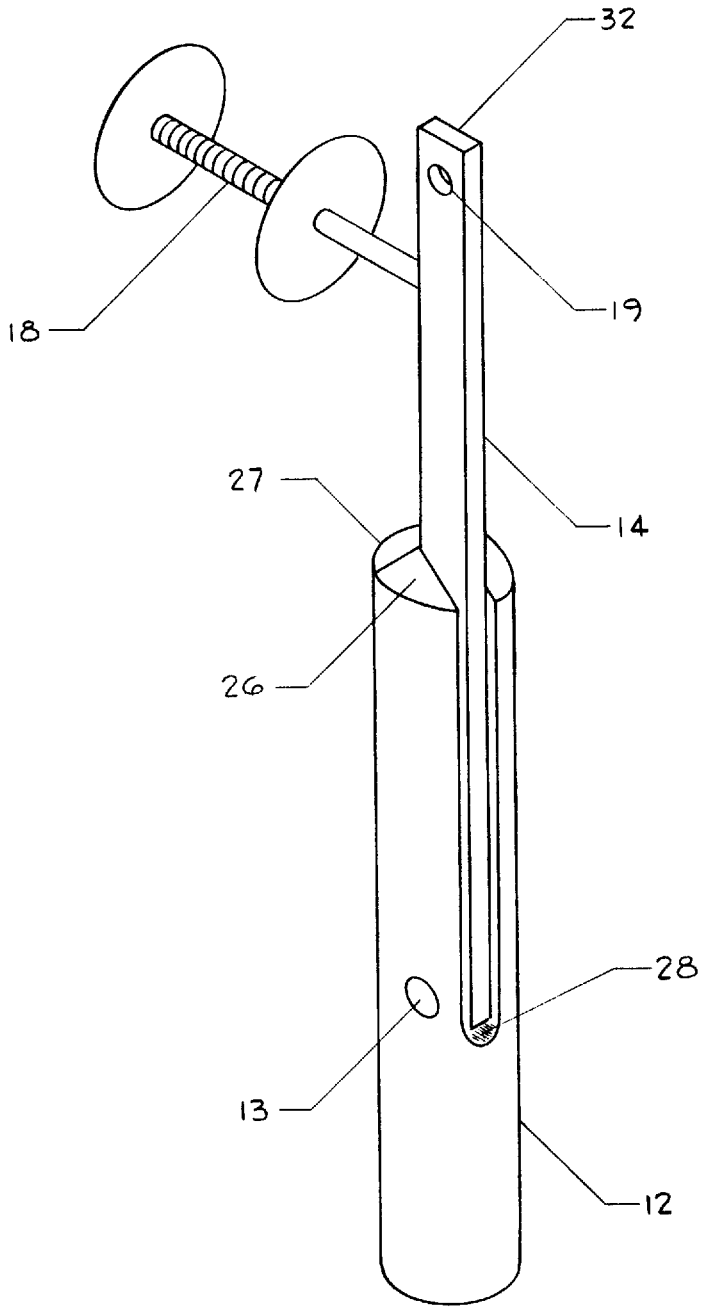
FIG. 3B is a perspective view of the lifting apparatus shown in FIG. 3A in its resting or vertical position.

An elongate body 12 is pivotally connected to an arm 14, as shown in FIGS. 3A and 3B. In the preferred embodiment, the elongate body 12 is substantially cylindrical in shape and the arm 14 has a solid geometric shape.

The type of material used in the body 12 and the arm 14 and the specific dimensions primarily depend on the size and weight of the object to be lifted. In one embodiment, the body 12 and arm 14 are made of a steel alloy; the body is approximately twelve inches in length, by one and one-half inches in diameter; and the arm is approximately twelve inches long, by one and one-half inches wide, by one-half inch thick. Of course the length of the body is primarily disctated by the diameter of the access port in the pipe to be lifted.

The body 12 includes a primary radial slot 28, preferably starting from a first end 27 of the body 12 and extending longitudinally to a point just shy of the center of gravity of the body 12. (In the preferred embodiment, this point is approximately the longitudinal mid-point of the body 12.) It should be noted that the machining of slot 28 affects the location of the center of gravity. Therefore, the slot usually terminates at the mid-point of the body 12, while the center of gravity is slightly closer to the second end of the body. The slot 28 must be sufficiently wide to permit entry and egress of the arm 14.

Figure 4B:
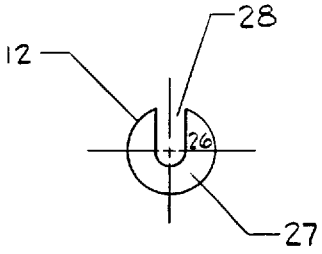
FIG. 4B is a first end view of the present invention taken along line 4B—4B of FIG. 4A showing the beveled area and the slot, before the arm is pivotally connected to the body.
Figure 3C:
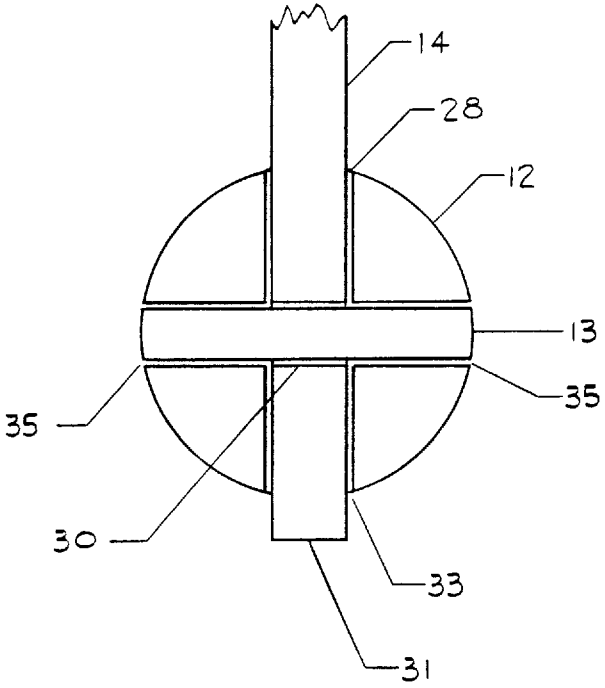
FIG. 3C is a cross-sectional view of the subject invention taken along line 3C—3C of FIG. 3A.

A means for pivoting the body 12 with respect to the arm 14 is described with reference to FIGS. 3C, 4 and 9. The arm 14 includes a pivot opening 30 at its first end 31. At the pivot point 33, the body has two prop openings 35 diametrically opposed to each other across the slot 28. The diameter of the prop openings 35 are generally equal to the diameter of the pivot opening 30.

The first end 31 of the arm is inserted into the primary radial slot 28. The pivot opening 30 of the arm 14 is aligned with the prop openings 35 of the body 12. A pin 13, having a diameter slightly less than the diameter of the openings 30, 35, is inserted through the openings and the ends of the pin 13 may be welded to the body 12, allowing the body 12 to pivot about the arm 14.

Figure 9:
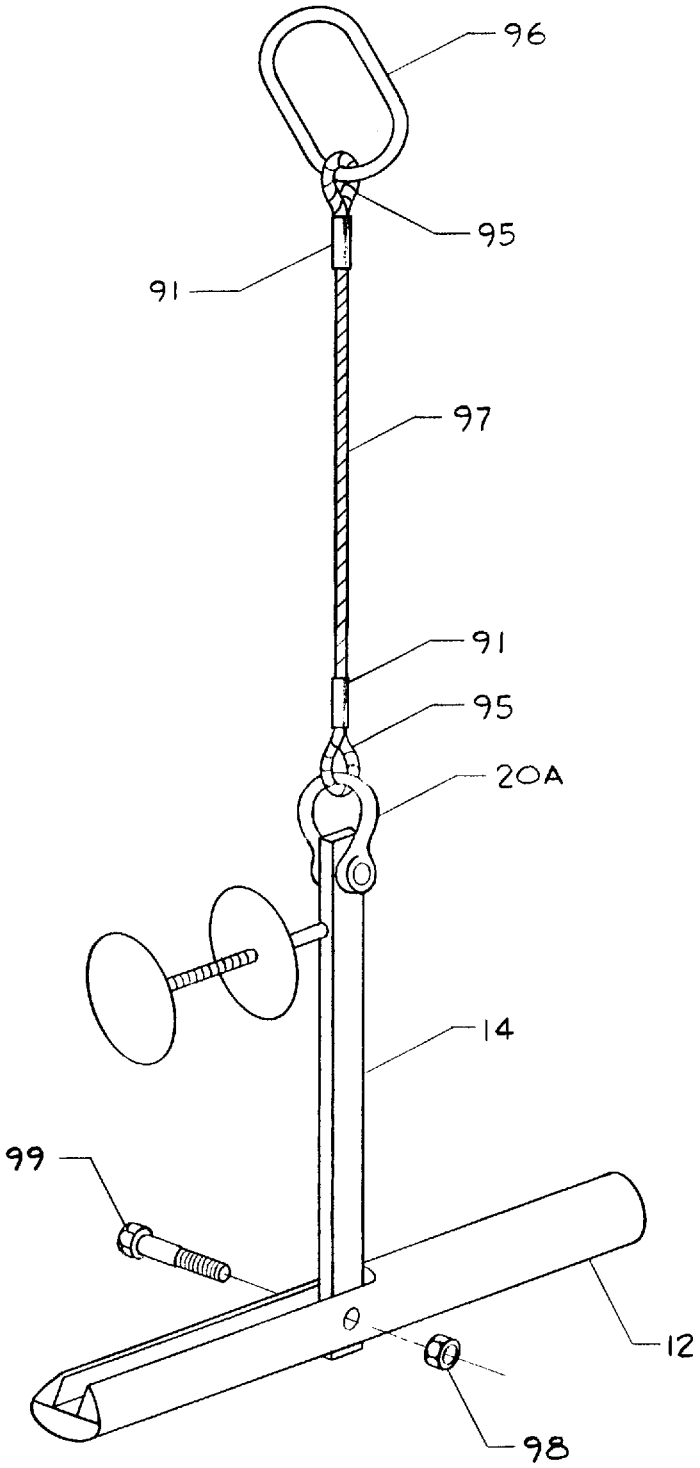
FIG. 9 is an alternate embodiment of the subject invention using a hardened steel bolt.

A preferred embodiment of the subject invention is shown in FIG. 9. Some situations may require that the pin be removable in order to inspect the apparatus 10 for wear and damage. In order to ensure that the pin has not been damaged or bent by exceeding the rated lifting capacity of the subject apparatus, or that the openings 30, 35 have not been damaged the pin can be removably attached to the body 12. Accordingly, a hardened steel bolt 99 (e.g., Grade 8) and nut 98 assembly may be used in place of the welded pin 13. In one embodiment, the use of a two inch long by one-half inch diameter bolt has been shown to support over two and one-half tons.

Alternatively, a pin 13 having cotter pins at each end may also be used. The removable pin or bolt/nut assembly allows the arm to be separated from the body in order to inspect the entire lifting apparatus 10. If any part of the lifting apparatus is damaged, it can easily be replaced.

Figure 8:
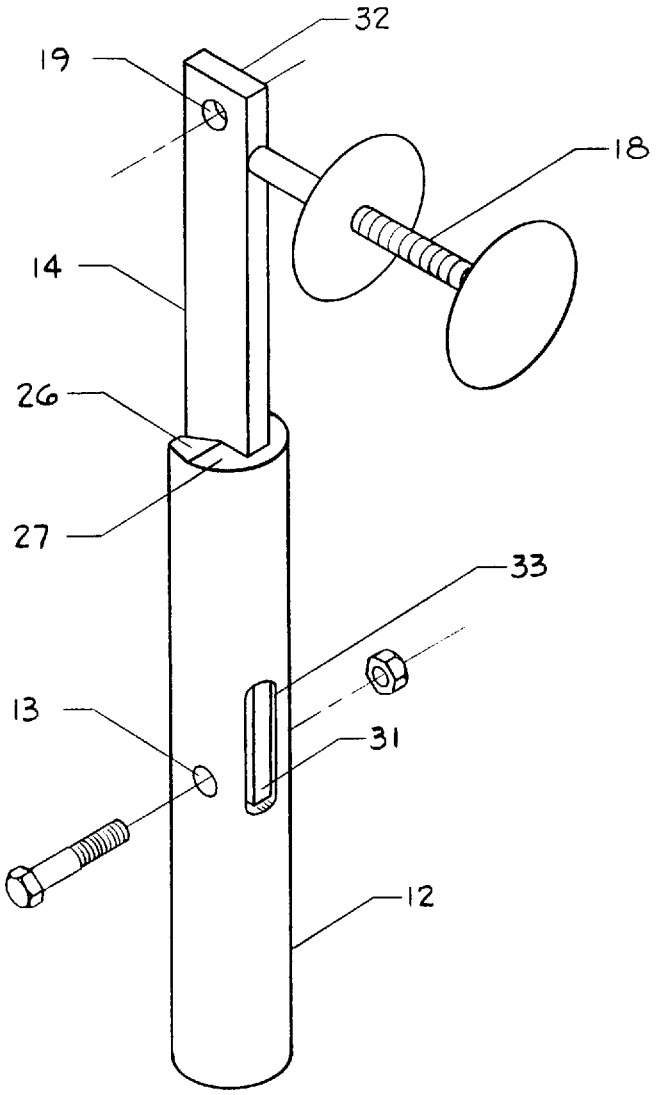
FIG. 8 is a bottom perspective view of the present invention in its resting position.

Since the pin 13 (i.e., the pivot point) is situated at a point closer to the first end 27 of the body 12 than the body's center of gravity, the body 12 assumes a position substantially parallel to the arm 14 when the lifting apparatus 10 is suspended by the arm 14 (see FIGS. 3B and 8). This substantially vertical orientation of the lifting apparatus 10 is referred to as its rest position. In this position, the arm 14 is nestled within the slot 28. This provides a more streamlined profile for the lifting apparatus 10, making it easier to be inserted into the lifting port of the pipe.

The body 12 may pivot about the arm 14 to a substantially transverse position with respect to the arm 14 (see FIG. 3A). The arm 14 exits the slot 28 and the body may rotate substantially 90 degrees to form a T, which is called its lifting position. The substantial mid-point of the body proximate the termination end 88 of the slot 28 preferably limits the rotational travel of the body 12 such that the body does not substantially exceed a transverse position with respect to the arm 14.

The length of the arm 14 is preferably greater than one-half of the length of the body. (Although, the thickness of the pipe may also dictate the ultimate length of the arm 14. It is preferred that a portion of arm 14 extend through the lifting port, beyond the exterior of the pipe when the body is secured inside the pipe.) Accordingly, in its rest or vertical position, the arm 14 is nestled within the primary slot 28 of the body leaving access to a second hole 19 for the insertion of a clevis or other shackle 20 and ultimate connection to a crane or other apparatus that provides the power to lift the pipe.

An important feature of the subject apparatus is that the arm 14 is preferably a rectangular steel bar. This provides durability in that the bar can withstand the rigors of lifting scores of pipe in a day without being damaged by the lip of the lifting port of the pipe to be lifted. Also, the regular shape allows easier entry and egress from the slot 28.

Figure 7:
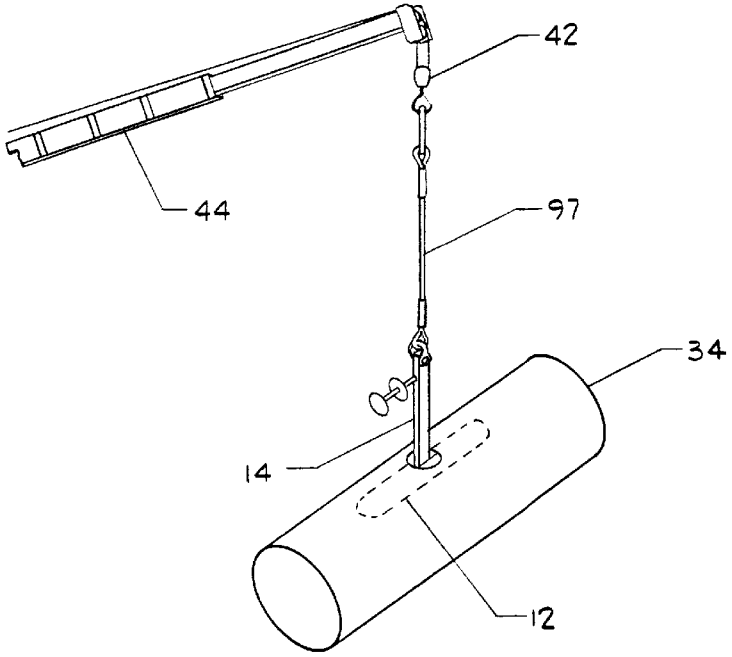
FIG. 7 is a perspective view of a pipe section being lifted by a crane using the instant invention.
Figure 5:
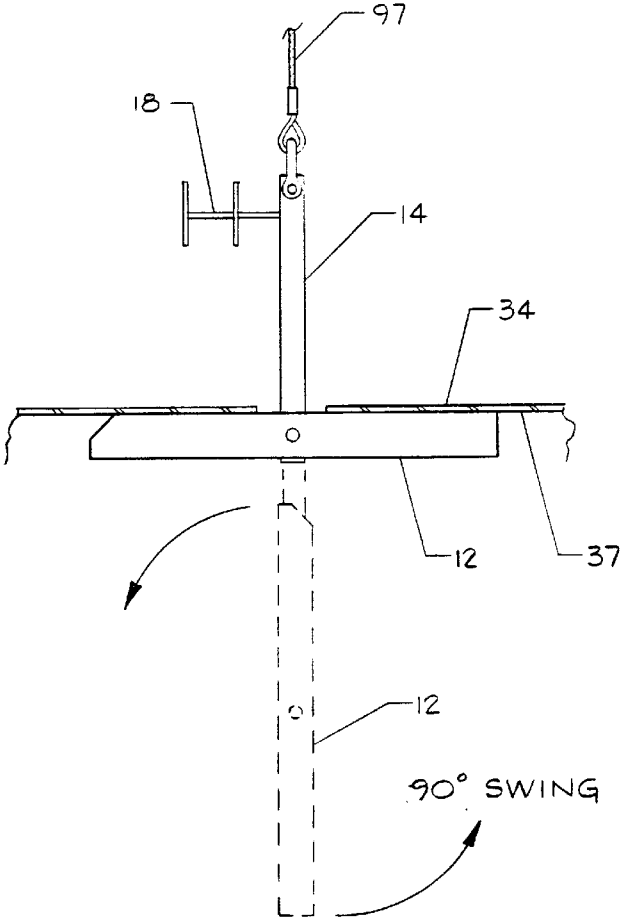
FIG. 5 is a side elevational view showing (in dashed lines) the present invention in its vertical resting position after it is inserted into a pipe section, and (in solid lines) after the invention has assumed its lifting or "T" position.
Figure 6:
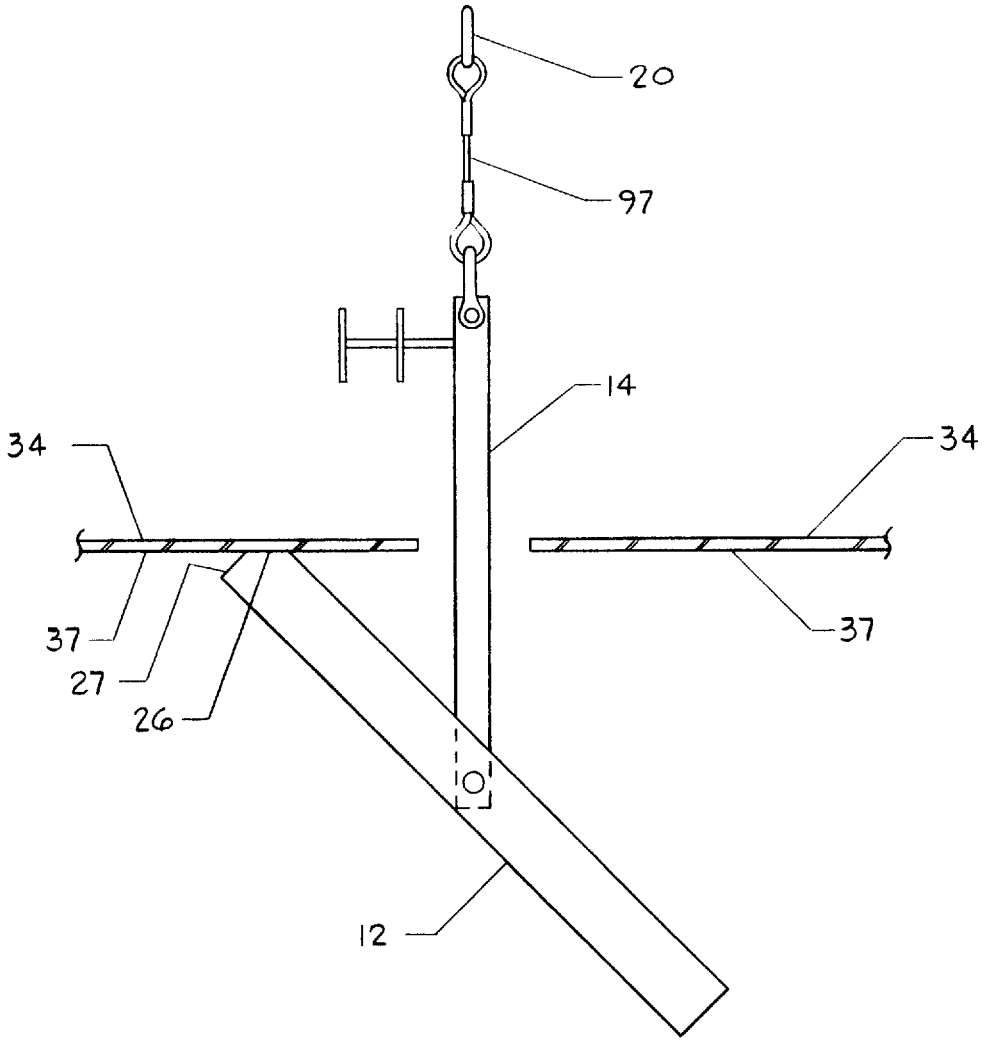
FIG. 6 is a side view of the instant invention as the first end of the body engages the inner surface of the pipe wall to initiate the rotation of the tubular body toward its lifting position.

Referring now to FIGS. 5–7, a use of the instant invention will now be discussed. The apparatus 10 can be used to lift a variety of heavy objects, including pipes, fittings, cable boxes, etc. In the following example, the lifting apparatus 10 will be used in connection with the lifting of a reinforced concrete pipe (RCP) 34. RCP's are one of the most common pipes used to contain and transport potable water and sewage. RCP's are generally manufactured in a form with a lift port 36 in the top of the pipe at approximately the lengthwise middle of the pipe 34.

Figure 1:
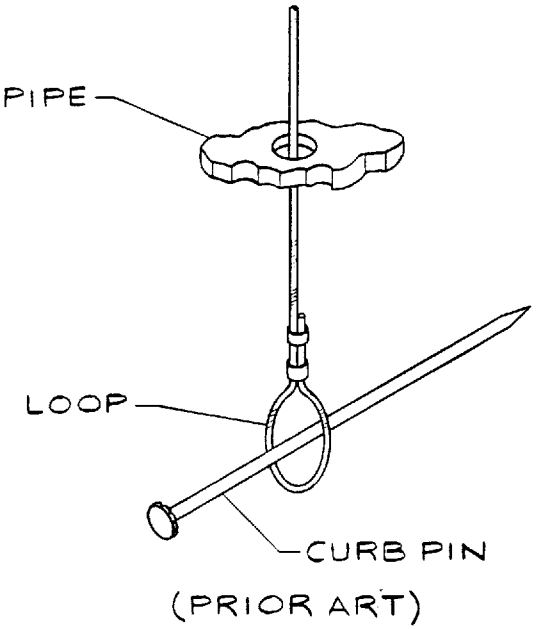
FIG. 1 is a perspective view of a prior art loop and curb pin device used for lifting pipes.

The lift port 36 at the top of each section of RCP is used by the manufacturer to remove the RCP from its form. If the installer uses the loop and curb pin to lift each pipe section, as described previously (see FIG. 1), the lifting port 36 is left open as it leaves the manufacturer. However, if the installers use the previously described pipe hooks (see FIG. 2) then the lift port may be sealed with mortar before leaving the manufacturer's property. The lifting port 36 in the pipe section is preferably left open when the installer uses the subject invention.

After the dirt has been excavated at the pipe burial site, the installer inserts the apparatus 10 into the hole at the top of the pipe. To assist in inserting the apparatus 10 into the lift port 36, a handle 18 may be attached (e.g., by welding) proximate the second or top end 32 of the arm 14. (Note that for heavy duty lifting, the dimensions of the subject lifting apparatus 10 are increased, thereby increasing its weight. Accordingly, two diametrically opposed handles may be attached to the arm.)

Since the center of gravity (COG) of the apparatus is below the pivot point (i.e., the COG is closer to the second end 29 of the body 12), the body 12 is substantially parallel to the arm 14 when the apparatus is suspended from the second end 32 of the arm.

Since the arm is nestled within the slot 28, and body 12 remains in a vertical orientation, almost concentricly located with the arm 14, it can be easily inserted into the lift port 36 at the top of the pipe 34. This important feature allows the apparatus to be inserted from the outside of the pipe. Accordingly, a person is not required to enter the pipe to utilize the subject invention. Furthermore, if the port is sufficiently large, or the crane operator is sufficiently skilled, only a single worker is needed to lift the pipe. In fact, no worker has to even approach the pipe since the crane operator can drop the subject apparatus 10 into the lifting port without leaving the cab of the crane.

When the body has been fully inserted into the interior of the pipe 34, the apparatus 10 is positioned approximate the perimeter of the lift port 36 either by a worker standing proximate the pipe section 34 using the handle 18 or by the operator of the crane. As the arm is withdrawn from the interior of the pipe 34, the first end 27 of the body 12 engages the interior of the upper wall 37 of the pipe 34 (see FIG. 6), and the body 12 begins to pivot about the pin. The engagement of the first end 27 of the body 12 against the interior of the upper wall 37 may also be initiated by shaking or swinging the arm by the operator of the crane as the arm is withdrawn from the interior of the pipe. As the shaking movement continues, the arm tends to exit and enter the slot 28 and eventually the first end 27 of the body 12 will engage the pipe.

The first end of the pipe is preferably beveled at a portion intersecting the slot 28. After the edge of the first end 27 makes initial contact, the beveled portion 26 of the first end 27 engages the interior wall 37, allowing the first end of the body 12 to slide more easily along the interior wall 37 of pipe 34. As the arm 14 continues to be withdrawn from the pipe, it separates from the body 12 by exiting from slot 28. Body 12 continues to co-act with arm 14 by pivoting about the pin 13 until body 12 rotates substantially 90 degrees, and nearly the entire length of body 12 contacts the interior wall 37. Body 12 is substantially parallel to the longitudinal axis of the pipe and substantially perpendicular to arm 14 (i.e., it is now in its T or lifting position, with slot 28 facing generally upwards). The body 12 will remain in this lifting position as long as upward tension or force is applied to second end 32 of arm 14.

Beveled edge 26 can be designed to meet a particular requirement. However, for use in many applications, the plane of the cut is perpendicular to the plane defined by slot 28 and at a 45 degree angle to the longitudinal axis of body 12.

As seen in FIG. 6, body 12 bridges the opening of lift port 36. Accordingly, the length of body 12 is determined by the diameter of the lift port 36. That is, the length of body 12 must be greater than the diameter of the lift port 36.

It is preferable to orient the longitudinal axis of the elongate body 12 generally parallel to the longitudinal axis of the pipe 34, as shown in FIG. 7. This position distributes the weight of the pipe across a larger surface area of body 12, decreasing the possibility of damage to pipe 34. In addition, this orientation allows the beveled edge 26 to slide relatively easily along the interior wall 37 of the pipe 34.

Figure 4A:
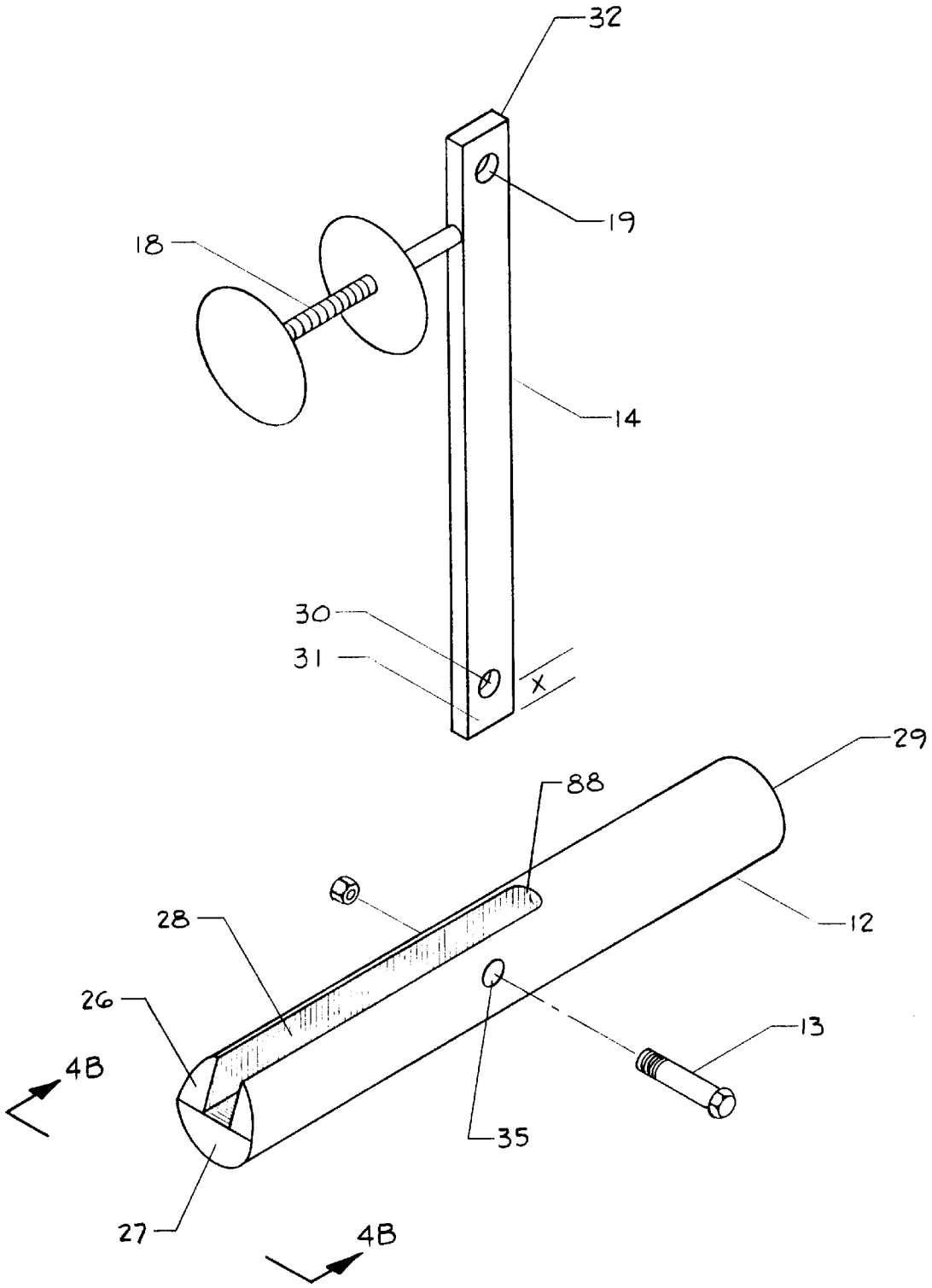
FIG. 4A is an exploded perspective view of the present invention.

During testing, it has been shown that the primary limiting factor with respect to the maximum weight that can be lifted by the apparatus 10 is the distance X of the pivot hole 30 at the first end of arm 14 (see FIG. 4A). That is, the pin 13 would literally rip off the bottom portion 31 of the first end 27 of arm 14 if the weight of the pipe exceeds the limits of the steel used to manufacture the arm 14. Therefore, one embodiment may have the radius of the body 12 be greater than the distance X of the bottom portion 31 of arm 14. However, in order to reduce manufacturing costs, the preferred embodiment incorporates a secondary slot 33, as shown in FIG. 8, that permits the body 12 to rotate without the first end 31 of the arm 14 jamming into the body 12 at the bottom of slot 28. The secondary slot 33 is preferably machined into the body 12 directly opposite slot 28. This allows the bottom corner of arm 14 to clear the body without limiting the rotation of the body relative to the arm 14.

As can be seen in FIG. 7, the shackle 20 can be connected to a hook 42 of crane 44 or a similar piece of machinery used for heavy lifting duties. As the crane 44 lifts the pipe 34, the weight of the pipe 34 is distributed along the length of body 12. If pipe 34 is buried, it can be lifted with minimal excavation of the ground 38.

After pipe 34 is placed in the desired location, the arm 14 is lowered, lessening the tension of the chain and lowering body 12 with respect to the upper wall 37 of the pipe 34. Body 12 pivots about pin 13 and separates from the interior wall 37 of pipe 34, returning to its vertical resting position. The weight of the body 12 moves it into a position substantially parallel to arm 14 such that the arm is again accommodated within the slot 28. The body 12 can be easily removed from the interior of the tank.

FIG. 9 also shows an alternate arrangement for connecting the lifting apparatus 10 to a crane. A galvanized screw pin anchor shackle 20A is connected to the arm 14 via second hole 19. A steel cable 97 connects the shackle 20A to a master link 96. Each end of the cable 97 is looped around a thimble 95 and secured to the cable by swaged sleeves 91. The master link 96 can then be connected in a regular manner to a crane or backhoe.

Even though particular embodiments of the present invention have been illustrated and described herein, it is not intended to limit the invention. It is understood that modification and variation of the present invention may be made without departing from the spirit or scope of the following claims.

We claim:

1. An apparatus to assist in lifting objects comprising:

a) an arm having first and second ends and a generally rectangular cross-section, the first end of the arm having a pivot hole;

b) a cylindrically-shaped elongate body having a radial slot originating from a first end of the body and extending substantially to the lengthwise midpoint of the body, the body also having two fulcrum holes diametrically opposed across the slot; and c) a pin for inserting through the fulcrum holes and the pivot hole for providing a pivotal connection between the arm and the body, wherein the arm enters and exits the slot, thereby communicating with the slot, as the body pivots with respect to the arm.

2. The apparatus of claim 1 further characterized in that the orientation of the rectangular arm is such that its width is planar to said slot in the body and its thickness is perpendicular to the longitudinal axis of the body.

3. The apparatus of claim 2 further characterized in that the orientation of the pin is substantially perpendicular to the longitudinal axis of both the arm and the body.

4. The apparatus of claim 1 wherein the slot is dimensioned to accommodate the entry and egress of the arm, and the fulcrum holes are located proximate the body's lengthwise mid-point, wherein the body is moveable from a resting position, substantially parallel to the arm in which at least a portion of the arm is nestled within the slot, to a lifting position wherein the arm substantially exits the slot and the body is disposed substantially transverse to the arm.

5. The apparatus of claim 1 further comprising a shackle connected to the second end of the arm.

6. The apparatus of claim 1 wherein the pin can be removed allowing the arm to separate from the body in order to inspect and replace worn elements.

7. The apparatus of claim 6 wherein the removable pin is a bolt and nut assembly.

8. The device according to claim 1 further comprising a handle proximate the second end of the arm.

9. A device for assisting in the lifting of objects comprising:

a) a cylindrically-shaped elongate body having a radial slot extending from a first end of the body to substantially the lengthwise midpoint of the body;

b) a pin;

c) an arm in the shape of a bar having a generally rectangular cross-section and being pivotally mounted to said body via the pin, the pin being located on the body near to the body's center of gravity, but closer to said first end of the body than is the center of gravity of the body, whereby the body is biased by gravity toward a position on its pivot in which it is suspended from the arm in a position substantially parallel to the arm such that the arm communicates with the slot; and d) means limiting the travel of said body when pivoting such that the body does not substantially exceed a transverse position with respect to the arm.

10. The device of claim 9 wherein the pin is removable and comprises a bolt and nut assembly.

11. The device according to claim 10 in which the body includes a slot extending from said closer end of the body to at least the pivot point so that the arm is nestable with the body when positioned substantially parallel to the body.

12. The device according to claim 11 further comprising a handle proximate the end of the arm furthest away from said body.

13. The device of claim 9 wherein the pin is permanently affixed to said body.

14. A method of lifting a pipe comprising the steps of:

a) inserting an apparatus having a generally rectangularly-shaped arm and a cylindrically-shaped body that pivots about the arm into a port of the pipe;

b) engaging an end of the apparatus against the interior wall of the pipe;

c) rotating said apparatus such that the body is substantially transverse to said arm;

d) applying a force on said arm to lift the pipe.

* * * * *